United States Patent [19]

Looney

[11] 4,084,809

[45] Apr. 18, 1978

[54] SHEET STACKING APPARATUS

[75] Inventor: John H. Looney, Fairport, N.Y.

[73] Assignee: Xerox Corporation, Stamford, Conn.

[21] Appl. No.: 767,705

[22] Filed: Feb. 11, 1975

[51] Int. Cl.[2] ..... B65H 31/36; B65H 29/18

[52] U.S. Cl. ..... 271/220; 198/815; 271/201; 271/202

[58] Field of Search ..... 271/220, 221-224, 271/177, 178, 198, 200, 201, 202, 80, 174, 215, 217, 219, 207, 34; 198/815; 214/6 G

[56] References Cited

U.S. PATENT DOCUMENTS

| | | | |
|---|---|---|---|
| 2,933,314 | 4/1960 | Stobb | 271/215 |
| 3,051,332 | 8/1962 | Richert et al. | 271/202 X |
| 3,078,983 | 2/1963 | Philips | 198/815 |
| 3,749,395 | 7/1973 | Bazzarone et al. | 271/215 X |

*Primary Examiner*—Bruce H. Stoner, Jr.

[57] ABSTRACT

Apparatus for accurately controlling registration of incoming sheets against a stop with minimal buckling. The apparatus includes a roller positioned on top of the stack of sheets which are registered against the stop. A belt encircles the roller and extends thru a slot formed in the stop. The roller is supported by a double pivoted linkage incorporating a counter weight to set a predetermined tension on the belt.

2 Claims, 1 Drawing Figure

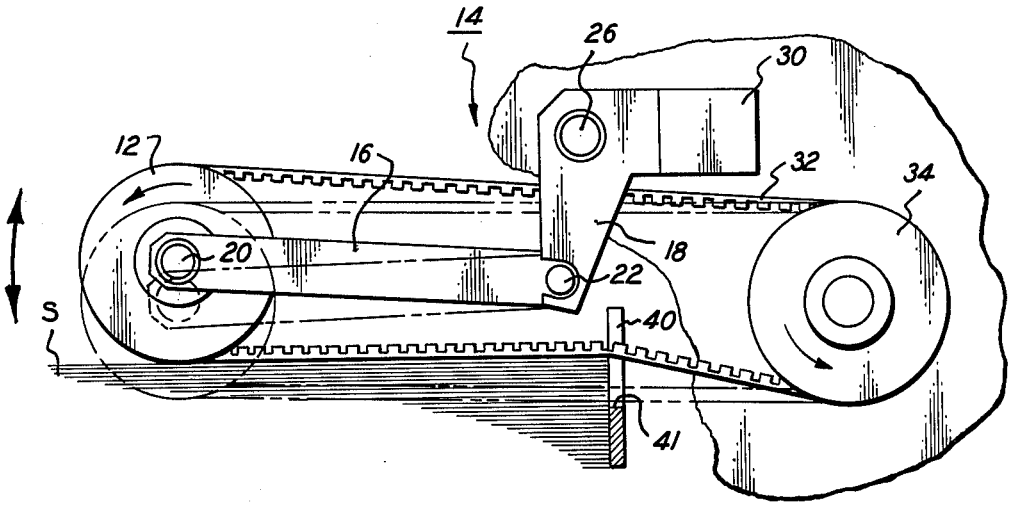
14
26
30
12
16
32
34
20
18
22
S
40
41

SHEET STACKING APPARATUS

BACKGROUND OF THE INVENTION

This invention relates to a sheet stacking apparatus for stacking sheets neatly in a stack in preparation for stapling or binding as for example when sheets are received from a copier/duplicator system. A problem arises in assuring the alignment of sheets along one edge as they are stacked in preparation for stapling or binding as, for example, when sheets are stacked in a pile as they are received in the output of a copier or duplicator reproduction system. It will be appreciated that it is essential that when sheets are stacked in a pile for the purpose of stapling or binding that these sheets must be aligned along one edge. It will be appreciated that it may be necessary for an operator to continually give attention to the adjustment of sheets in a stack such that proper stacking action is achieved. In many situations additional equipment, such as a jogging mechanism is necessary to be operated to effect the proper stacking action desired.

Accordingly, with the view of reducing operator fatigue and the necessity of separate mechanisms to which the sheets must be inserted to effect the proper stacking action, the present invention enables proper stacking and registration of sheets in a stack for a finishing function, such as, stapling or binding, etc.

OBJECT OF THE INVENTION

It is therefore a general object of this invention to improve the stacking of copy sheets.

It is another object of this invention to insure the alignment of sheets along one edge as they are received in a stack for preparation for stapling or binding.

It is still a further object of the present invention to eliminate the bouncing or skewing of sheets received in a sheet receiving tray or the like.

BRIEF DESCRIPTION OF THE DRAWING

The above and added advantages of the present invention will become more apparent after the reading the following detailed description which will be read in conjunction with the accompanying drawing which shows a side sectional view of the sheet stacking apparatus according to the present invention.

DETAILED DESCRIPTION OF THE INVENTION

As shown in the drawing, the apparatus of the invention stacks incoming sheets in registration and without buckling and comprises a floating roller 12 positioned by gravity on top of a stack of incoming sheets S. The roller 12 is supported by a double pivoted linkage which includes a link 16 and a link 18. Roller 12 is supported from line 16 on axis 20. Link 16 is pivotally supported from link 18 on an axis through pin 22. Link 18 is pivotally supported on an axis through pin 26. A counterweight 30 serves to maintain a predetermined tension upon a belt member 32 which is supported at one end on the roller 12 and at the other end by a roller 34 which is driven by any suitable drive mechanism. The speed of the belt member 32 is greater than the speed of entering sheets S so as not to inhibit their entry into the stack.

It will be appreciated then that the pivot 14 enables the roller 12 and belt 32 to ride on the stack while maintaining alignment of the axis of the rollers 12 and 34. It will be noted that instead of the use of gravities for the loading of the roller and belt a spring biasing device could be used. A sheet registration station is defined by an elongated stop member 40 which abuts the sheets received in the stack. Stop member 40 is formed with a slot 41 thru which belt member 32 passes.

It will now be appreciated that the belt tension and slight wrap at the leading edges of the topmost sheets in the stack provides a desirable drive force for registering the topmost sheet in the stack and aligning it with the preceding sheets below it. Furthermore, buckling of the incoming sheets is prevented by the aforementioned tension and wrap. It will be further appreciated that the weight of the roller 12 and its supporting link 16 serve to impart forces on the incoming sheets to carring them towards the registration zone.

While it has been shown and described and pointed out the fundamental novel features of the invention as applied to a preferred embodiment, it will be understood that various omissions and substitutions and changes in the form and details of the device illustrated and its operation may be made by those skilled in the art without departing from the spirit of the invention.

What is claimed is:

1. Sheet stacking apparatus comprising:

a frame, stop means positioned on said frame in a sheet path to register the leading edge of incoming sheets received in a stack, a roller member positioned to rest on the top of the stack of the incoming sheets, said roller member being supported to float on the top of the stack and constrained to move in a generally vertical direction, said roller member being supported by a first link member connected to the axis thereof, said first link member being pivotally supported on an axis parallel to the axis of said roller member by a second link member, said second link member being pivotally supported by said frame, a belt member encircling said roller member and extending in a predetermined path thru a passage defined in said stop means, said belt member having a predetermined tension thereon sufficient to exert a force at the leading edges of the topmost sheets in the stack to effect registration of the sheets without buckling thereof, said second link member including a counter weight portion for controlling the tension on said belt member, and means for moving said belt member at a predetermined rate greater than the speed of the incoming sheets so as not to inhibit entry of the sheets into the stack.

2. Apparatus according to claim 1 wherein said stop means includes an elongated bar across the sheet path and a slot formed therein to define a passage corresponding to the width of said belt member.

* * * * *